US007828002B2

(12) United States Patent
Boldsen

(10) Patent No.: US 7,828,002 B2
(45) Date of Patent: Nov. 9, 2010

(54) COMBINED SUNSHADE AND HEATER WITH LIGHT

(75) Inventor: Peter Christian Boldsen, Risskov (DK)

(73) Assignee: Idéen ApS, Solbjerg (DK)

( * ) Notice: Subject to any disclaimer, the term of this patent is extended or adjusted under 35 U.S.C. 154(b) by 0 days.

(21) Appl. No.: 12/085,813

(22) PCT Filed: Nov. 29, 2006

(86) PCT No.: PCT/DK2006/000672

§ 371 (c)(1),
(2), (4) Date: Jun. 30, 2008

(87) PCT Pub. No.: WO2007/062653

PCT Pub. Date: Jun. 7, 2007

(65) Prior Publication Data

US 2009/0032076 A1 Feb. 5, 2009

(30) Foreign Application Priority Data

Nov. 30, 2005 (DK) ..... 2005 01692
Jul. 7, 2006 (DK) ..... 2006 00940

(51) Int. Cl.
*A45B 3/00* (2006.01)
*F24C 1/12* (2006.01)

(52) U.S. Cl. ..... 135/16; 135/92; 135/29; 126/92 B; 362/102

(58) Field of Classification Search ..... 135/91–92, 135/94, 96, 98, 15.1, 16, 29; 126/92 B, 92 A, 126/92 AC; 362/102, 217.05; 431/253; 219/200–201
See application file for complete search history.

(56) References Cited

U.S. PATENT DOCUMENTS 5,964,233 A 10/1999 Clark et al.
6,102,031 A 8/2000 Waters
6,164,273 A * 12/2000 Waters ..... 126/92 B
6,192,878 B1 * 2/2001 Waters ..... 126/92 AC
6,298,866 B1 10/2001 Molnar, IV
6,336,450 B1 1/2002 Collet (Continued)

FOREIGN PATENT DOCUMENTS

EP 0976979 7/1999

(Continued)

*Primary Examiner*—Winnie Yip
(74) *Attorney, Agent, or Firm*—James Creighton Wray; Meera P. Narasimhan

(57) ABSTRACT

There is disclosed a combination of a sunshade and a terrace heater with light 1. The combination includes a sunshade/canopy 2 mounted on support rods 4 that may be pivoted between a collapsed and a suspended state. Moreover, the combination includes a light element and a heater element with a lattice cage 9 and a reflector plate 10 disposed above it. The canopy 2 is formed of an annular body with a central aperture where the reflector plate 10 has a size of circumference largely corresponding to the central opening in the canopy. The reflector plate 10 extends over a distance from the lattice cage 9 corresponding to the height of the lattice cage 9. Hereby is formed an interspace 13 for ejecting radiant heat with the canopy in collapsed condition when the support rods 4 are connected with the inner side of the reflector plate 10 via a hinge 5 in a position immediately close to the lattice cage 9.

17 Claims, 19 Drawing Sheets

U.S. PATENT DOCUMENTS

| | | | | |
|---|---|---|---|---|
| 6,422,232 | B1 | 7/2002 | Ashton et al. | |
| 6,446,623 | B1 * | 9/2002 | Resmo et al. | 126/92 R |
| 6,470,877 | B1 * | 10/2002 | Waters | 126/92 AC |
| 6,550,470 | B2 * | 4/2003 | Liang | 126/92 B |
| 6,745,759 | B2 * | 6/2004 | Bossler | 126/92 B |
| 7,003,217 | B2 * | 2/2006 | Bachinski et al. | 392/411 |
| 7,278,418 | B2 * | 10/2007 | Duphily et al. | 126/92 B |
| 7,537,015 | B1 * | 5/2009 | Molnar et al. | 135/16 |

FOREIGN PATENT DOCUMENTS

| | | |
|---|---|---|
| NL | 1022184 | 8/2004 |
| WO | WO 02/24019 | 3/2002 |

* cited by examiner

COMBINED SUNSHADE AND HEATER WITH LIGHT

This application claims the benefit of Danish Application No. PA 2005 01692 filed Nov. 30, 2005, Danish Application No. PA 2006 00940 filed Jul. 7, 2006 and PCT/DK2006/000672 filed Nov. 29, 2006, which are hereby incorporated by reference in their entirety.

FIELD OF THE INVENTION

The present invention concerns a combination of a sunshade and a terrace heater with light, including a sunshade canopy which is mounted on a canopy support with hinged, pivotable support rods for pivoting between a collapsed state and a suspended state, and with a heater element with lattice cage and disposed hereinabove a reflector plate arranged at the top of a central column.

By the term lattice cage as used in the present application is meant a housing or a frame around, or as a part of, the heater element.

BACKGROUND OF THE INVENTION

Through many years, private persons as well as restaurants have used combinations of market sunshades and terrace heaters for providing comfort and warmth in periods where the temperature drops so that it is comfortable to sit in the outdoors.

For cafés and restaurants there is the advantage that the period for serving in the outdoors can be prolonged, hereby increasing the number of guests.

The traditional solutions are unfortunately associated with drawbacks, partly of visual and partly of technical character. Visually, many separate terrace heaters and separate sunshades may give a disorderly impression, appearing unfavourable to a harmonic combination of tables, chairs and sunshades. The sunshades will usually be provided for shading and high temperatures, but are also provided for prolonging serving in the outdoors when the temperature falls and a risk of dew is present. Terrace heaters will thus often appear visually as a foreign element which does not fit into the traditional environment.

Terrace heaters are known as separate independent units but may also be mounted on walls, e.g. in connection with canopies mounted on the house wall or combined with free-standing sunshades.

At the same time, the use of terrace heaters and sunshades may be unsuitable due to the fire risk when the terrace heaters are placed under the sunshades.

Furthermore, the use of separate sunshades and terrace heaters would be unsuitable due the space taken up with these, with consequent limitation of the access to tables and chairs.

Previously, there have been proposals to combine a sunshade with a terrace heater. From WO 98/58211 and U.S. Pat. No. 6,336,450 are known combinations of sunshade and terrace heater as mentioned above. These prior art designs have the advantage that a sunshade canopy is provided outside the reflector plate so that it is easier to retain the heat developed by the heater element and which the reflector plate directs at persons sitting in immediate vicinity of the terrace heater. In the area under the sunshade canopy, a greater heat comfort may thus occur.

These combination units will be advantageous in that there is only one vertical columnar support of sunshade as well as terrace heater.

However, they are associated with drawbacks as the terrace heater cannot be used separately or with collapsed canopy. Furthermore, there will also be a risk of fire injuries if persons are touching the support rods for the sunshade canopy.

The prior art sunshades, terrace heaters and combination units are also associated with the drawback that they do not include any light source. In connection with using traditional terrace heaters in the evening and night hours, the presence of a light source is often required.

OBJECT OF THE INVENTION

It is the purpose of the present invention to indicate a combination of a sunshade and a terrace heater with light that relieves the above drawbacks, and which enables providing a stand-alone combination of a sunshade and a terrace heater with light which furthermore may be used both at night and at daytime as well as with the sunshade in the collapsed position.

DESCRIPTION OF THE INVENTION

According to the present invention, this is achieved with a combination of the type specified in the introduction, which is peculiar in that the canopy is an annular body with a central aperture, that the reflector plate has a circumference largely corresponding to the central aperture, that the reflector plate extends out from the lattice cage with a distance at least corresponding to the height of the lattice cage, that the support rods are hinged at the inner side of the reflector plate at a position close to the lattice cage so that the canopy body in the collapsed state is disposed under the lattice cage.

If the canopy is in the collapsed state, there will appear a spacing between the reflector plate and the canopy corresponding to the height of the lattice cage due to the size of the central aperture. Thus it will be possible to use the heater element as radiant heat will be emitted in the interspace between the reflector plate and the upper side of the canopy, corresponding to the edge area located in the central aperture of the canopy. Furthermore, it will enable collapsing of the canopy without any risk immediately after the heater element has been switched off.

As a hinge between the support rods and the inner side of the reflector plate will be situated close to the lattice cage, the support rods will be disposed at a position relatively close to the lattice cage. The support rods may extend from the hinge point inclining downwards in direction towards the central column so that the outermost free end of the support rods are disposed in immediate vicinity of the central column in such a way that the collapsed canopy forms a conical shape.

It will be possible to design the support rods of two sections extending straightly, and where the first section located opposite the reflector plate is angularly bent relative to the outer section of the support rods with an angle corresponding to the cone angle with which the lattice cage is made. In the collapsed state, the support rods will hereby be disposed with the support rods extending largely in parallel with the surface of the lattice cage in the first section, and the second section of the support rods will extend in parallel with and in close contact with the centre column. Hereby, there will be the largest possible free area where the radiant heat can be emitted without any risk of contact with the canopy and the lowermost part of the canopy will block a free view to a lesser extent.

By using a light element which can be disposed below, above or at level with the terrace heater, several advantages are attained. Firstly, a variable disposition of the light element will ensure the ability to control the direction of the light radiation, which is advantageous in many respects.

By light element as used in the present application is meant an element which is capable of providing lighting. It may thus be any kind of light element. A light element may e.g. include a halogen bulb, an incandescent bulb, a fluorescent tube, a gas lamp, a kerosene lamp. One or more light elements, which are not necessarily powered by the same source of energy, may be used.

According to a preferred embodiment, the combination according to the invention is peculiar in that at least one heater element is a gas burner. The gas burner has the advantage that its use is independent of the presence of other energy sources, including electricity. By using a gas burner, a very high degree of freedom of application is thus provided. Furthermore, the gas burner has the advantage that there is possibility of producing a very great heating power and rapid temperature adjustment.

According to a preferred embodiment, the combination according to the invention is peculiar in that the at least one heater element is an electric heater. The electric heater has the advantage that fuel elements are not to be replaced, as is the case with e.g. using gas. At the same time, the electric heater provides the possibility of producing a large heating power.

According to a preferred embodiment, the combination according to the invention is peculiar in that at least one light element is powered with energy from the same source of energy as the said least one heater element. Such an embodiment has the advantage that access to a source of energy is the only thing needed.

According to a preferred embodiment, the combination according to the invention is peculiar in that gas is used for powering the heater element as well as the light element. According to such an embodiment it will be possible to use a lamp which is provided with gas from the same source as the gas burner in the terrace heater.

According to a further embodiment, the combination according to the invention is peculiar in that both heater element and light element are powered by electricity. By electricity as used in the present application is meant all kinds of electricity. The energy may thus stem from a battery, the power network or from other electric source of energy. Moreover, it is possible at the same time to use two different electric sources of energy for the heater element and the light element, respectively. For example, there may be used a battery charged by solar energy for powering the light element while at the same time the heater element is supplied with electricity from the power network. Moreover, it is possible to use the same electric sources of energy for the heater element and the light element, respectively. Such an embodiment has the advantage that it is only necessary to control one source of energy. For example, it will be possible to connect the light as well as the heater element to the power network.

According to a further embodiment, the combination according to the invention is peculiar in that different sources of energy are used for powering the heater element and the light element, respectively. There may e.g. be used an electric light element in combination with a heater element consisting of a gas burner. Conversely, it is possible to use an electric heater element in combination with a lighting element consisting of a gas lamp.

In addition, it is possible to use other forms of energy for powering the heater element and the light element, respectively. Hydrogen pills may e.g. be used. Thus there are no limits with regard to the choice of sources of energy. Among the possible sources of energy there may thus independently be selected sources of energy for heater element and lighting element, respectively.

A plurality of heater elements may be used. An embodiment containing several heater elements has the advantage that heat may be produced, even if one heat source fails. If a combination of a gas burner and an electric heater is used, it will be possible to maintain heating by using the electric heater when the gas cylinder becomes empty. The combination of a gas burner and an electric heater will also be advantageous in situations where the terrace heater is to be used, in places with as well as without access to electric power.

There is a risk that users may get in contact with the exposed support rods, even if they are disposed at the upper end of the combination at a position immediately under the reflector plate. In order to minimise heating, a combination according to a preferred embodiment of the invention will be peculiar in that the lattice cage at positions opposite the support rods have areas without lattice opening(s) closed for screening off radiant heat against the support rods in the collapsed state.

As the lattice cage will be provided with the plate-shaped parts where there are no lattice openings, or just with fewer lattice openings, the radiant heat and thereby the risk of heating of support rods are minimised.

For further reducing the risk of an inappropriate heating of the support rods, a combination according to a further embodiment of the invention will be peculiar in that each support rod is provided with a heat shield at least on the side facing the lattice cage. According to the invention, it is possible to form a heat shield of a part of the support rod itself, as this is made with a slit, or alternatively, the heat shield may be formed of a bent plate mounted on and spaced apart from the support rod. Alternatively, it is possible to make the plate by extrusion, and it will also be possible to use a plane plate.

In both cases, transfer of heat to the support rod or the side of the support rod facing the user will be prevented or minimised.

According to a further embodiment, sunshade canopy and canopy support are detachably mounted on the central column. Hereby it will be possible to dismount the sunshade part and use the terrace heater in a traditional way.

According to a preferred embodiment, the combination according to the invention is peculiar in that its lower end the central column includes a gas line for feeding at least one gas burner and at least one gas lamp. With such a design it is possible to place sunshade and terrace heater at the centre of a table. In this situation, the cage can be hidden under the table so that space is not taken up unnecessarily. Alternatively, the combination of sunshade and terrace heater can be used freely standing with the cage at the lower end of the central column. The cage will have a certain extent and therefore provide a secure supporting surface for the combined sunshade/terrace heater. For further safeguarding sunshade/terrace heater against overturning, it is preferred that at the lower end of the central column there is provided mounting means for fastening to the base. Such mounting means may be an earth rod or support legs projecting outwards from the column/cage. The legs may have such outer diameter that they by themselves provide stability, or alternatively the legs can be clamped/screwed onto the base.

It is also possible to make the sunshade/terrace heater with support legs combined with a bushing at the underside of the central column/cage with regard to mounting a detachable earth rod. In such a situation, one may optionally use support legs or earth rods, or both at the same time.

With the combined sunshade and terrace heater according to the present invention, it will be possible to attain enhancement of the efficiency of the reflector and retain the heat in a more efficient way due to the centrally disposed heater element under the sunshade canopy than would be possible with the prior art terrace heaters or in situations with separate terrace heaters provided under a sunshade.

Alternatively, it is possible to have a cage as an independent unit disposed beside the column instead of as a extension of the central column. In this situation, a gas cylinder or other energy element will thus stand beside a sunshade foot. This embodiment will be suited for daily setup, where sunshade/terrace heater (and gas cylinder if a gas burner is used) can be carried in and out individually.

Even if, according to the present invention, there is provided a free area between the sunshade canopy and the reflector screen so that the canopy body is not exposed to strong heat, it is preferred that the canopy is made of a non-combustible material, as e.g. carbon or Kevlar. The risk of fire damage is minimised hereby.

In order to make the structure as rigid as possible, it is preferred that the reflector plate is made diagonal or pyramidal as alternative to the known bowl-shaped, curving reflector plates. Alternatively, it is, however, possible to make the reflector plate circular/frusto-conical with the purpose of achieving rigidity in the structure. In practice, the reflector plate will be supplied as a separate unit in a separate package when buying a traditional terrace heater. The reflector plate may be composed of several identical bodies in order to allow for transport and packing.

As an alternative to a freely standing disposition, the combination of sunshade and terrace heater can be made as a construction that can be attached to a house front. In this situation, the reflector plate will ensure that unnecessary heat radiation does not reach the house, while also ensuring that a canopy extending out from the house front is disposed at the outer edge of the reflector plate. Also in this design, when collapsing the canopy will be provided in a position under the lattice cage so that there is possibility of free heat radiating from the lattice cage in the interspace formed between the reflector plate and the edge area of the canopy body situated closest to the reflector plate.

With regard to heating, sunshade/heat shield can be provided at its upper side with an eyelet for suspending by a hook or similar.

If the edge section of the sunshade canopy located closest to the lattice cage will cover an operating panel traditionally situated immediately under the lattice cage, it is possible to provide opening means, such as a zipper or metal button in parallel with one of the support rods so that a user may readily access the operating panel.

According to a preferred embodiment, the combination according to the invention is peculiar in containing a lighting element consisting of a gas lamp which is designed as a dish mounted on a burner upon which nozzles providing lighting are fastened. By covering the nozzles with gas incandescent mantles, they may function as light sources. This embodiment has the advantage that the dish shape reflects the heat and light away from the gas lamp, thereby contributing to lighting as well as heating.

According to a preferred embodiment, the combination according to the invention is peculiar in containing a lighting element consisting of a gas lamp surrounded by a grill which is designed as a frustum of a cone so that the light is diffused by the grill, which at the same time may contain a gas lamp designed as a dish with vertical axis of symmetry.

It is possible to use a heat shield made in aluminium and designed as pipes with internal pins enclosing round sticks of wood so that direct contact between pipe and stick is limited to the very small contact area between the pins and the sticks. The pin can be made from a non-combustible material with low thermal conductivity. Pipe and round sticks will largely thus be separated by air only.

According to a further embodiment, the combination according to the invention is peculiar in containing light elements consisting of fluorescent tubes, light diodes, incandescent or halogen bulbs. Alternatively, one or more rechargeable sun cell lamps may be used.

With the intention of adjusting the intensity of the used light element, it is possible to provide the light elements with adjusting mechanisms. In an embodiment where a gas lamp is used, such an adjusting mechanism may be designed as an adjustable valve that enables regulating the flow rate of gas to the gas lamp. In connection with embodiment models using electric light elements, the control may be provided through using a control system based on application of variable resistance.

Adjusting the heat production of the terrace heater in accordance with a specific heat demand may be provided by using a regulating valve that controls the gas flow rate to the gas burner.

According to a further embodiment, the combination according to the invention is peculiar in containing a plurality of light sources. Thus there may be combinations of one or more fluorescent tubes, light diodes, rechargeable solar cell lamps or incandescent or halogen bulbs. Such embodiments provide various possibilities for lighting.

According to a further embodiment, the combination according to the invention is peculiar in containing at least one gas lamp enclosed by a grill consisting of at least one section. By using a grill consisting of several sections, it is possible to control the light intensity in different directions. Thus it is possible to use symmetric as well as asymmetric lighting formations.

According to a preferred embodiment, the combination according to the invention is peculiar in including a terrace heater with a light element and no sunshade. Such an embodiment would be ideal if there is no need for a combination with a sunshade. In a situation where one desires to sit in the outdoors on a cool night, and at the same time having an opportunity of studying the night sky, such an embodiment would constitute a smart alternative to the terrace heater with collapsed canopy.

According to a further embodiment, the combination according to the invention is peculiar in including a sunshade and a terrace heater without light. Such an embodiment is more simple to produce and use. In situations, where no need for lighting exists, a such embodiment will be advantageous.

DESCRIPTION OF THE DRAWING

In the following, the invention will be explained in more detail with reference to the enclosed drawing, where.

DETAILED DESCRIPTION OF THE INVENTION

Identical or corresponding elements in the various embodiments will be provided with the same designations below.

Figure 1:
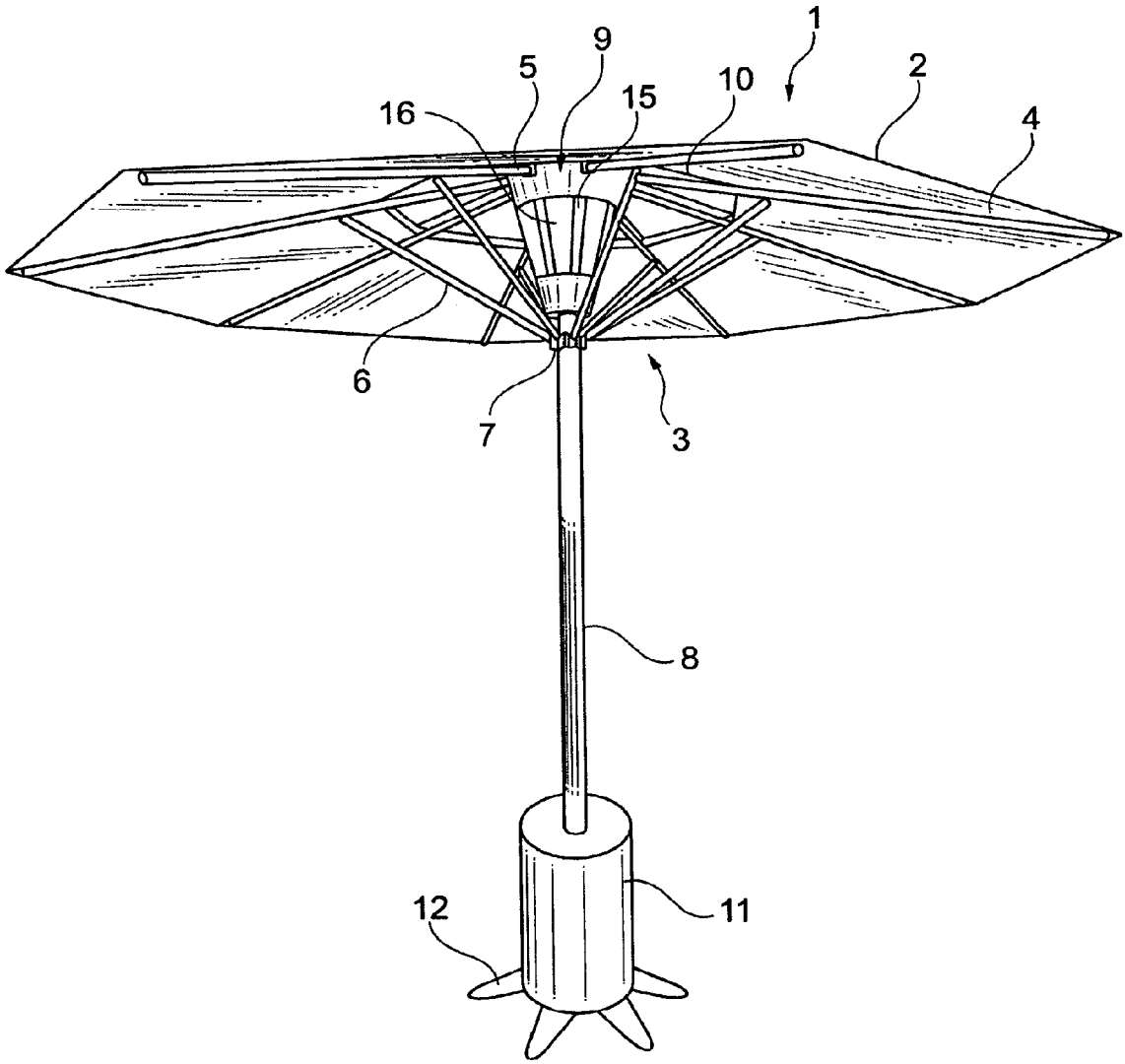
FIG. 1 shows a first embodiment of a sunshade/terrace heater with light according to a first embodiment for the present invention in suspended condition.

FIG. 1 shows a first embodiment of a combined sunshade and terrace heater with light 1. It comprises a sunshade canopy 2 which is mounted on a support 3 and support rods 4 that are pivotably suspended, and further support rods 6 which are connected with the first support rods 4 and a central slide 7 which may be displaced up and down on a central column. The central column 8 supports a gas burner 9 with a reflector plate 10 arranged with top at the column. At the bottom of the column 8 there is provided a cage 11 containing a gas cylinder or another energy element (not shown). The cage 11 is provided with support legs 12.

Hoses, pipes or lines (not shown) connected with a heater element inside the lattice cage 9 run inside the column 8.

Figure 2:
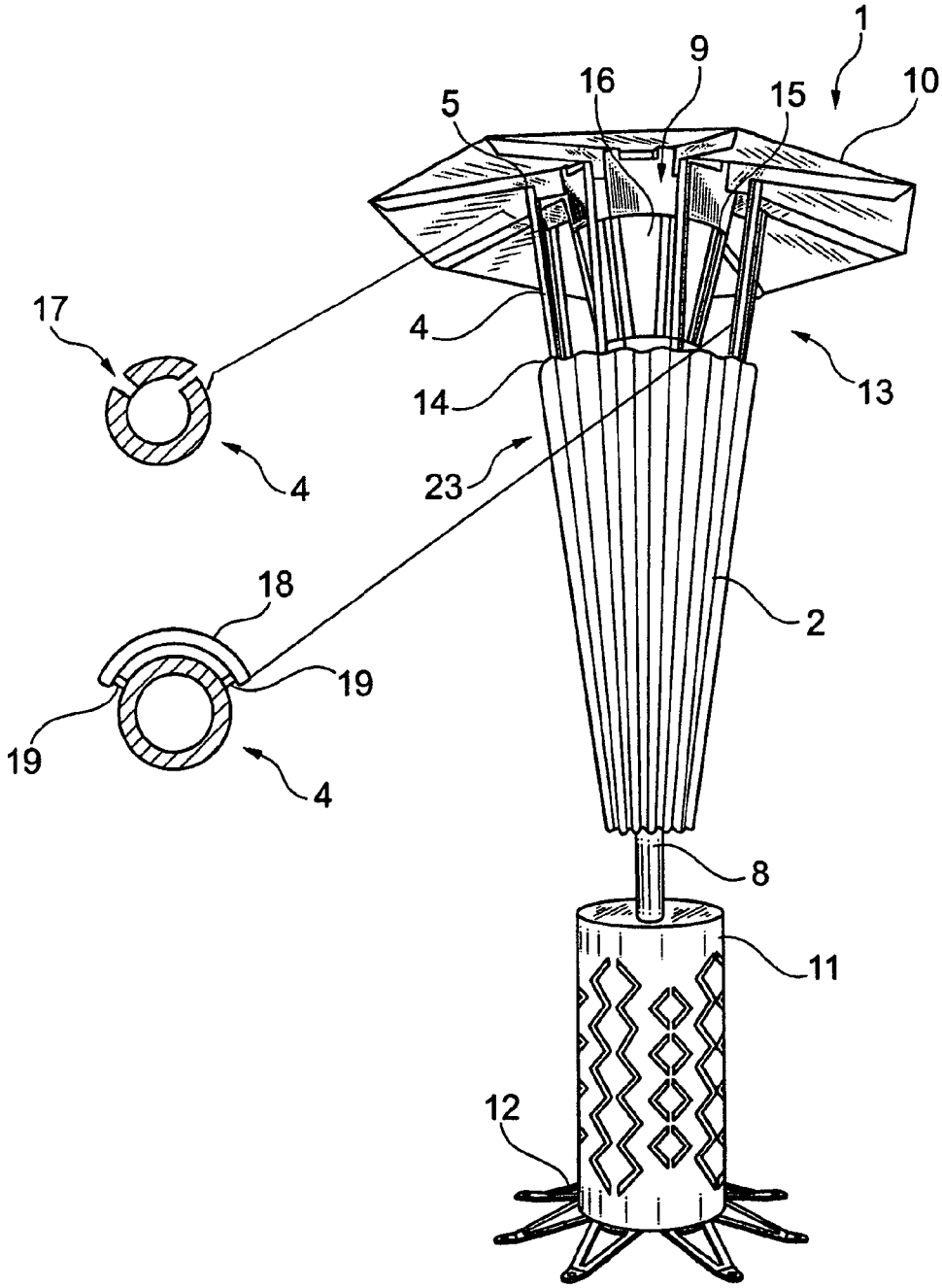
FIG. 2 shows the sunshade/terrace heater with lights shown in FIG. 1 in collapsed condition.

FIG. 2 shows sunshade/terrace heater with light 1 in suspended condition, and FIG. 1 shows the same sunshade/terrace heater 1 in collapsed condition. The canopy 2 is formed of an annular body having a central aperture corresponding to the reflector plate 10. By collapsing the canopy 2, an aperture 13 thus appears between a top side 14 of the canopy and the reflector plate 10. The reflector plate 10 has an extent corresponding to the height of the lattice cage 9. The lattice cage 9 may hereby, with the canopy in collapsed state, still be used as heat radiation occurs in the interspace 13.

In areas 15 opposite the support rods 4, the lattice cage 9 is closed, and there between exist areas 16 with lattice openings. Hereby is achieved screening of radiant heat by the support rods 4 when these are collapsed and are close to the lattice cage 9.

Lattice bars 4 may be provided with slits 17 at least in an area located opposite to the lattice cage 9 in order to reduce the heat transmission to the side facing outwards against the user. Alternatively, the lattice bars 4 may be provided with a heat shield 18 which via short connecting rods 19 is mounted on the lattice bars 4. In use, the heat shield 18 will be placed on the lattice bars facing the lattice cage 9.

Figure 3:
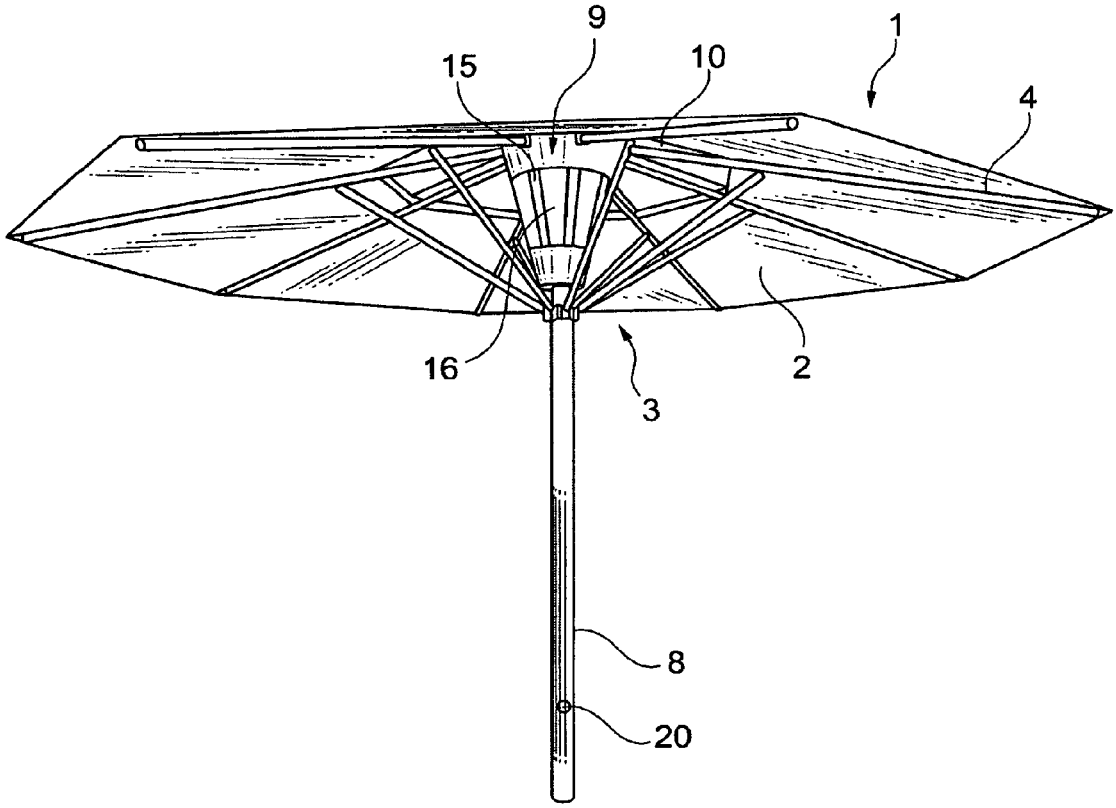
FIG. 3 shows a second embodiment of a sunshade/terrace heater with light according to the present invention in suspended condition.

FIG. 3 shows a combined sunshade/terrace heater with light corresponding to the one shown in FIGS. 1 and 2. However, in this design no lattice cage has been provided. In this embodiment, the column 8 is intended for disposition in a prior art sunshade foot, or for placing in an earth rod (not shown). In the column 8 is shown an aperture 20 for hoses, pipes or wires and regulator for supplying the heater element in the lattice cage 9.

Figure 4:
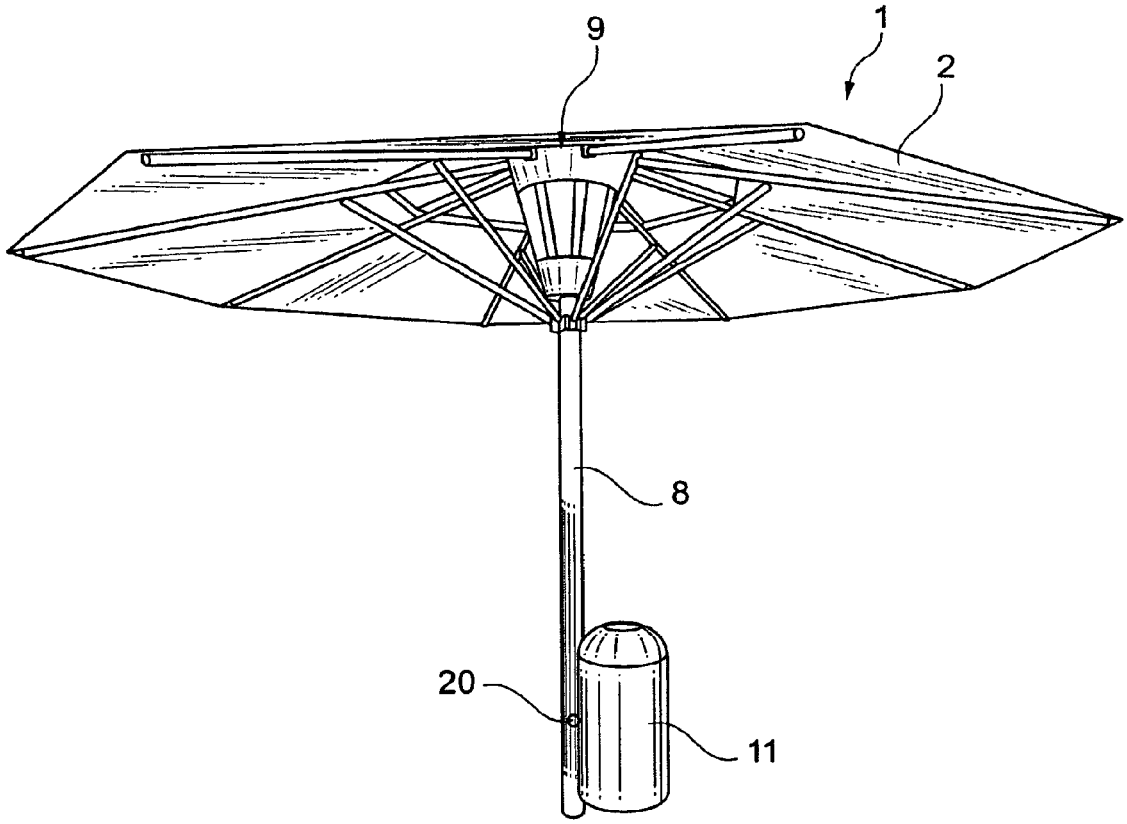
FIGS. 4-6 show drafts of various alternative embodiments of sunshade/terrace heater with light according to the invention.

FIG. 4 illustrates a combined sunshade/terrace heater with light 1 where a gas cylinder 21 is disposed beside the central column 8 in a free-standing position. The column is here fastened to the base with an earth rod (not shown).

Figure 5:
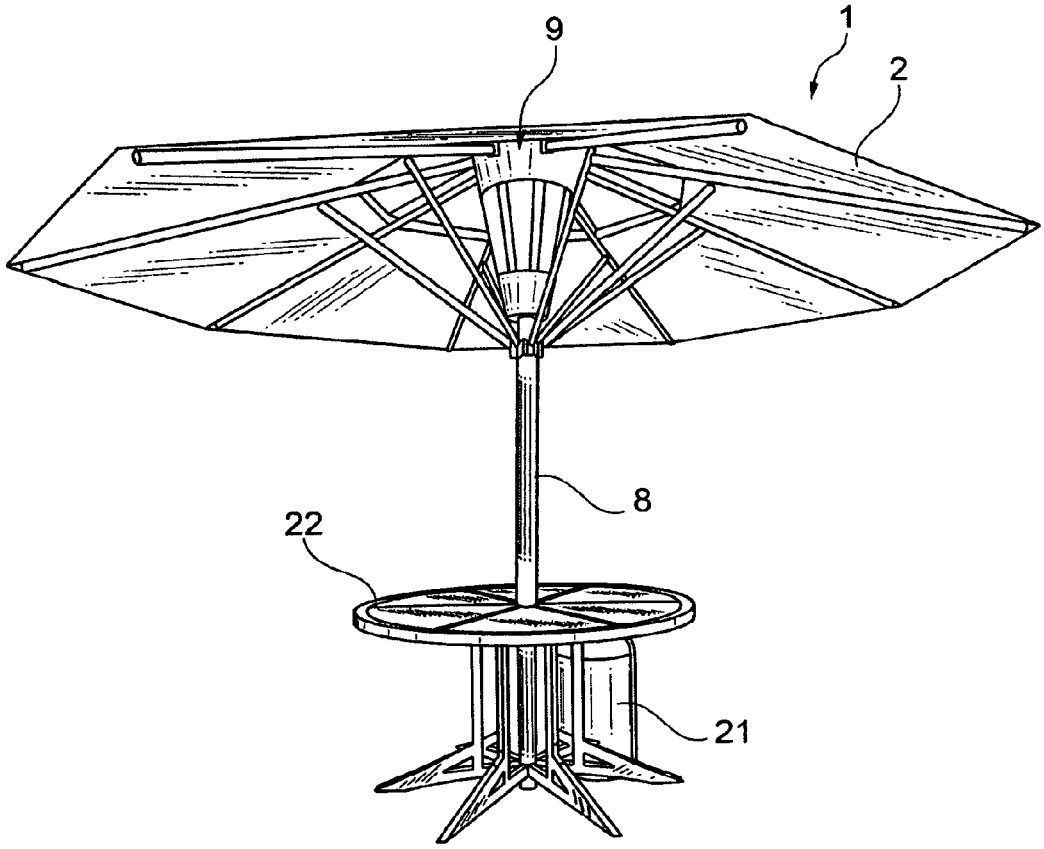

FIG. 5 illustrates a combined sunshade/terrace heater with light 1 where the column 8 extends through a central aperture in a table 22. The gas cylinder 21 is hidden under the table in a position beside the column.

Figure 6:
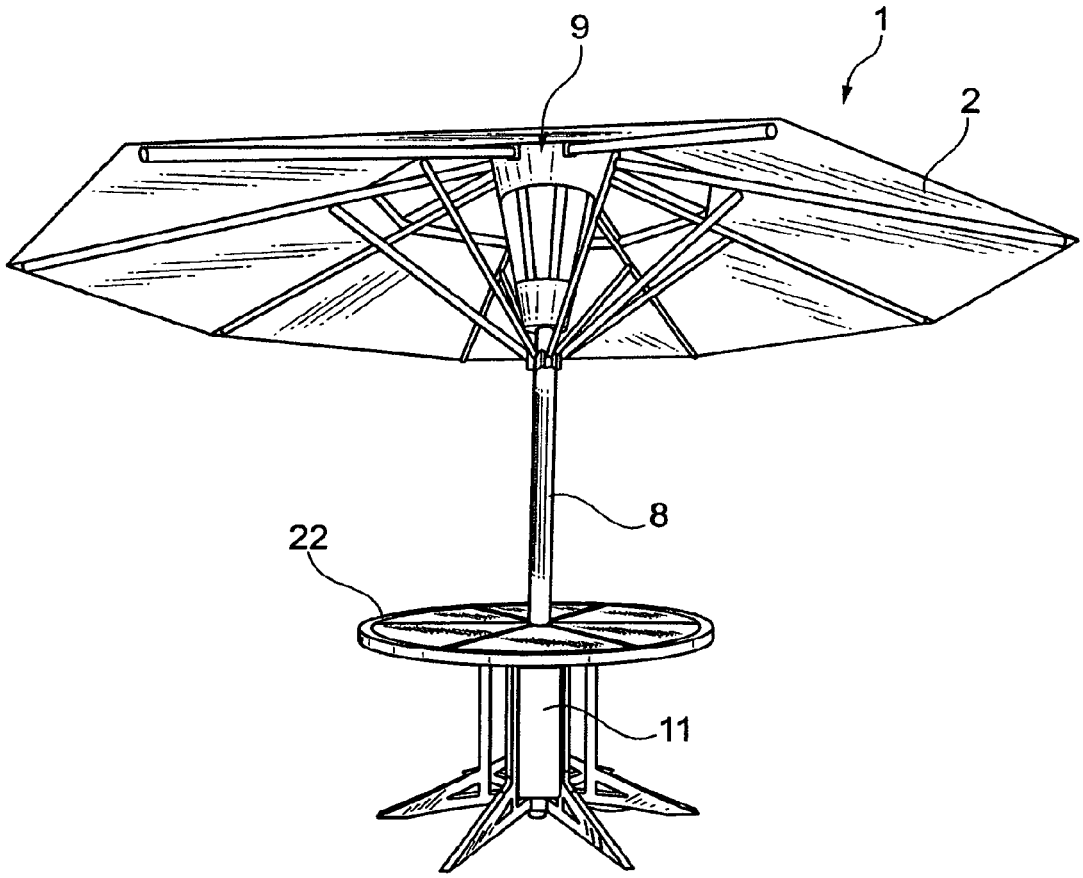

FIG. 6 differs from the embodiment shown in FIG. 5 in that at the bottom of the column 8 there is provided a cage 11 which contains a gas cylinder or other energy element.

Figure 7:
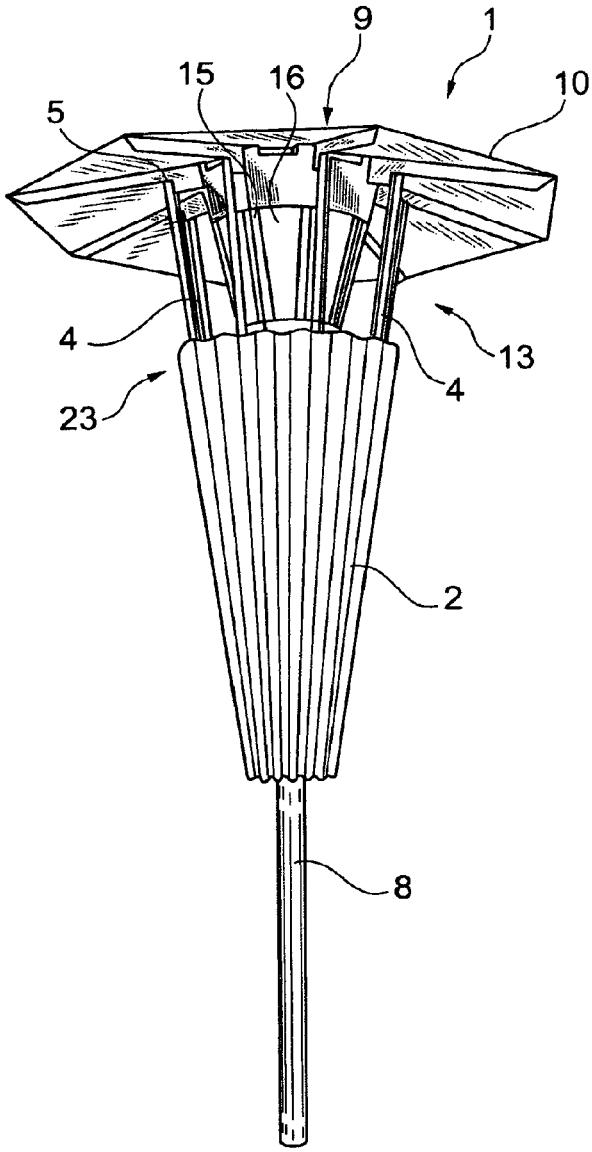
FIGS. 7 and 8 show a further embodiment of a sunshade/terrace heater according to the invention in collapsed condition and with dismounted sunshade canopy.
Figure 8:
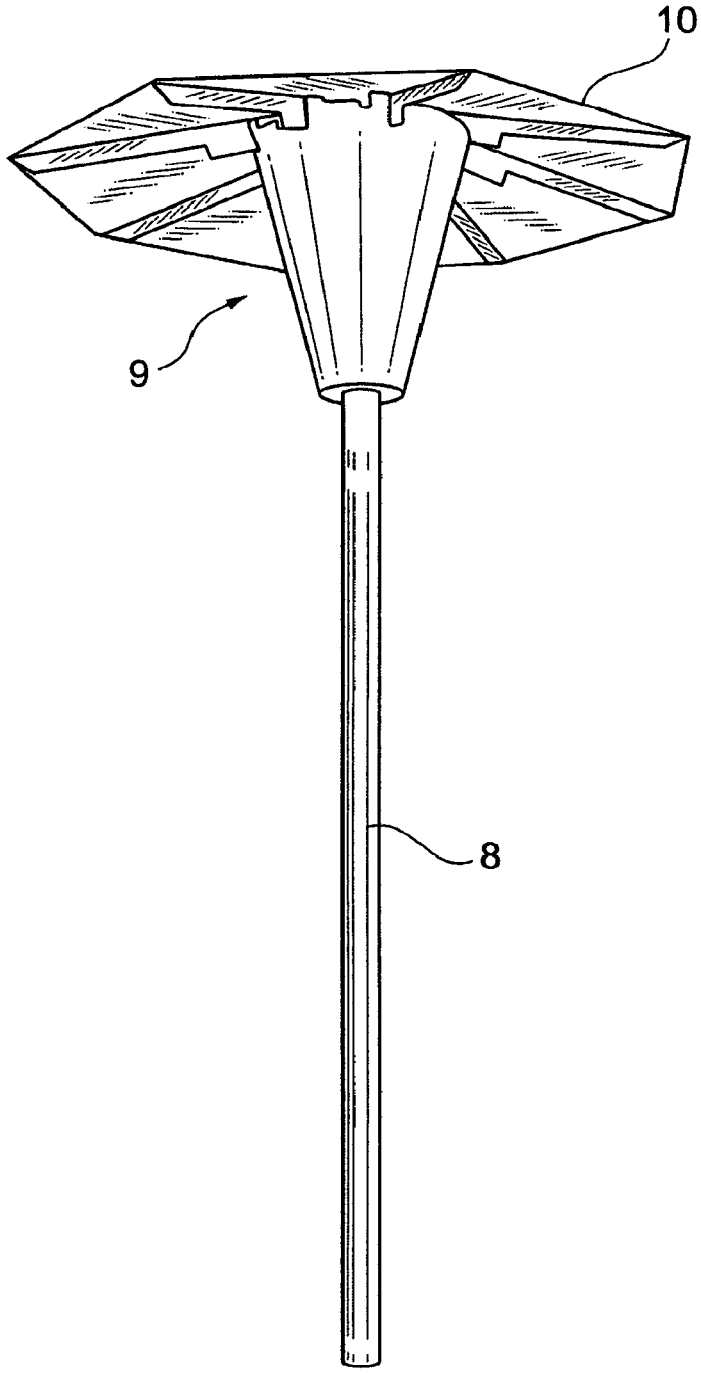

FIGS. 7 and 8 show a combined sunshade/terrace heater with light 1 in a situation with the canopy 2 and with dismounted canopy, respectively, used as traditional terrace heater. In this embodiment, no cage 11 is provided at the bottom of the column 8. The column can be fixed in an earth rod, sunshade foot or by using support legs. A cage containing a gas cylinder or an alternative energy element may in this embodiment be placed beside the column, corresponding to the embodiment shown in FIG. 4. In this embodiment, the power network may similarly be used as energy supply.

It is noted that an upper edge area 23 which is proximate to the interspace 13 may be provided with zippers, metal buttons or similar opening means that enable access to an operating panel (not shown) located immediately below the lattice cage 9. Such a possibility for opening and dismounting the canopy 2 may also be provided in the other embodiments. After dismounting the canopy 2, the support rods 4 may simply be taken off the hinges 5 by suitable application of hinge types. Hereby it will be possible to use the unit as a traditional terrace heater such as illustrated in FIG. 8.

Figure 9:
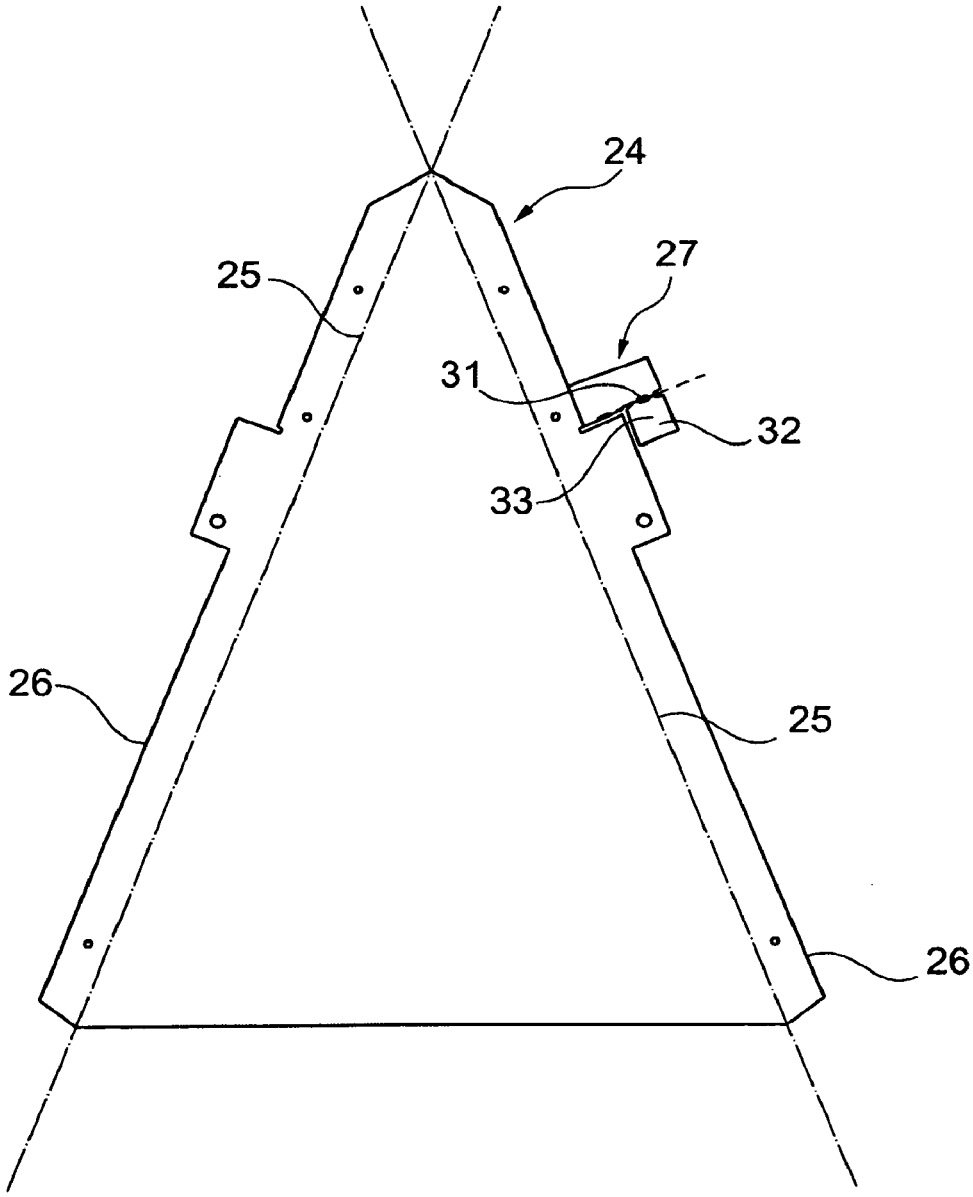
FIG. 9 shows an unfolded item for use in making a reflector plate in a sunshade/terrace heater with light according to the present invention.

In order to provided a rigid reflector plate 10, it is preferred to make it polygonal/pyramidal. The reflector plate 10 may thus be produced from a number of plate members 24, as shown in FIG. 9. Each of the plate members appear with a largely triangular shape. The plate members are provided with a bending line 25 for bending down edge areas 26 that are mutually attached, e.g. by using bolts or similar which enable assembling on the spot without special tools. Alternatively, assembly may also be effected by riveting, welding, soldering or in other ways. There is a lug 27 in the bent parts serving to bear against the lattice cage 9 and fixing the reflector plate. The lug 27 is provided with a further bending line 31 that enables bending of the part 32 of the lug. This part 32 is provided with a hole 33 intended for use for screwing on the lattice cage. A bending of about 90° about each of the bending lines 25 and 31 is performed. The plate member 24 will preferably be made by laser cutting.

Figure 10:
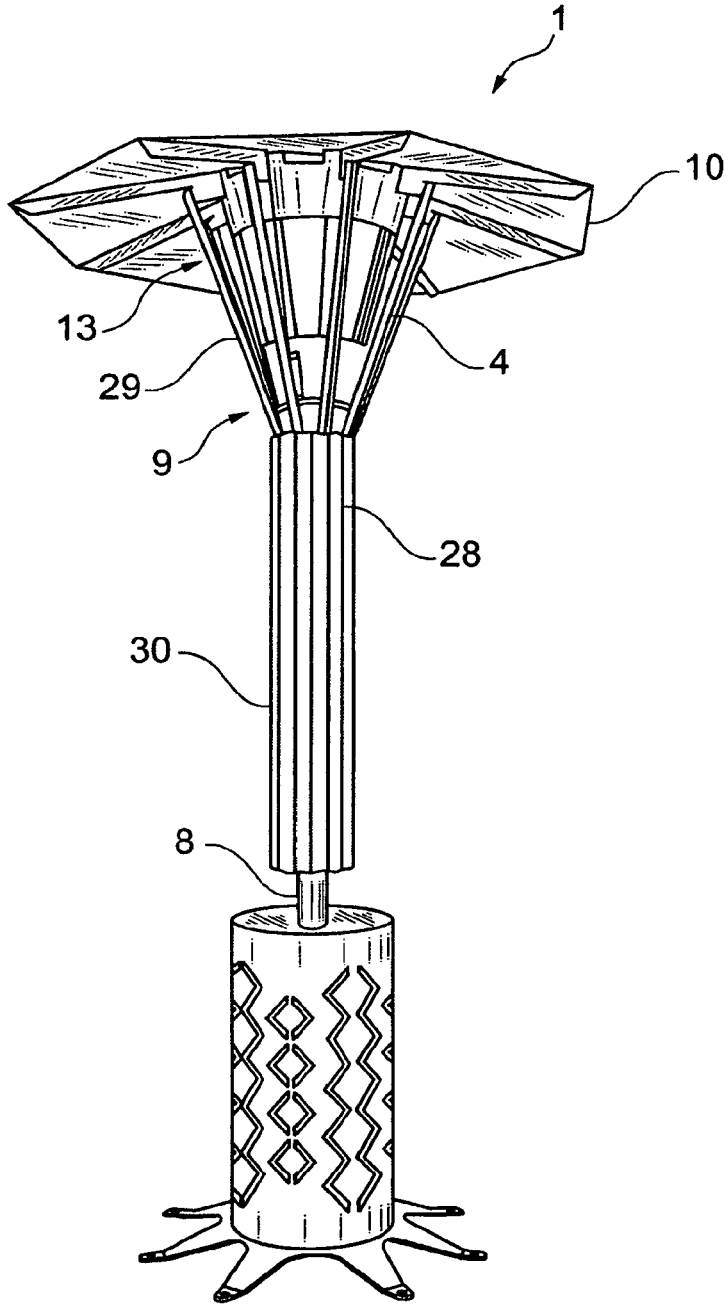
FIG. 10 shows a further embodiment of a sunshade/terrace heater with light according to the present invention in collapsed condition.

FIG. 10 illustrates a view essentially corresponding to FIG. 2. In this situation, the support rods 4 are provided with an angular bend at a position 28 which in use is located approximately at edge areas of the reflector plate 10. By providing the angular bend with an angular bending approximately corresponding to the angle of the lattice cage in relation to the column 8, the upper part 29 of the support rods 4 will run largely in parallel with the surface on the lattice cage, and outer parts 30 of the support rods 4 will run largely in parallel with the central column 8. Hereby is particularly securely formed a free interspace 13 with the radiating heat from the lattice cage 9.

Figure 11:
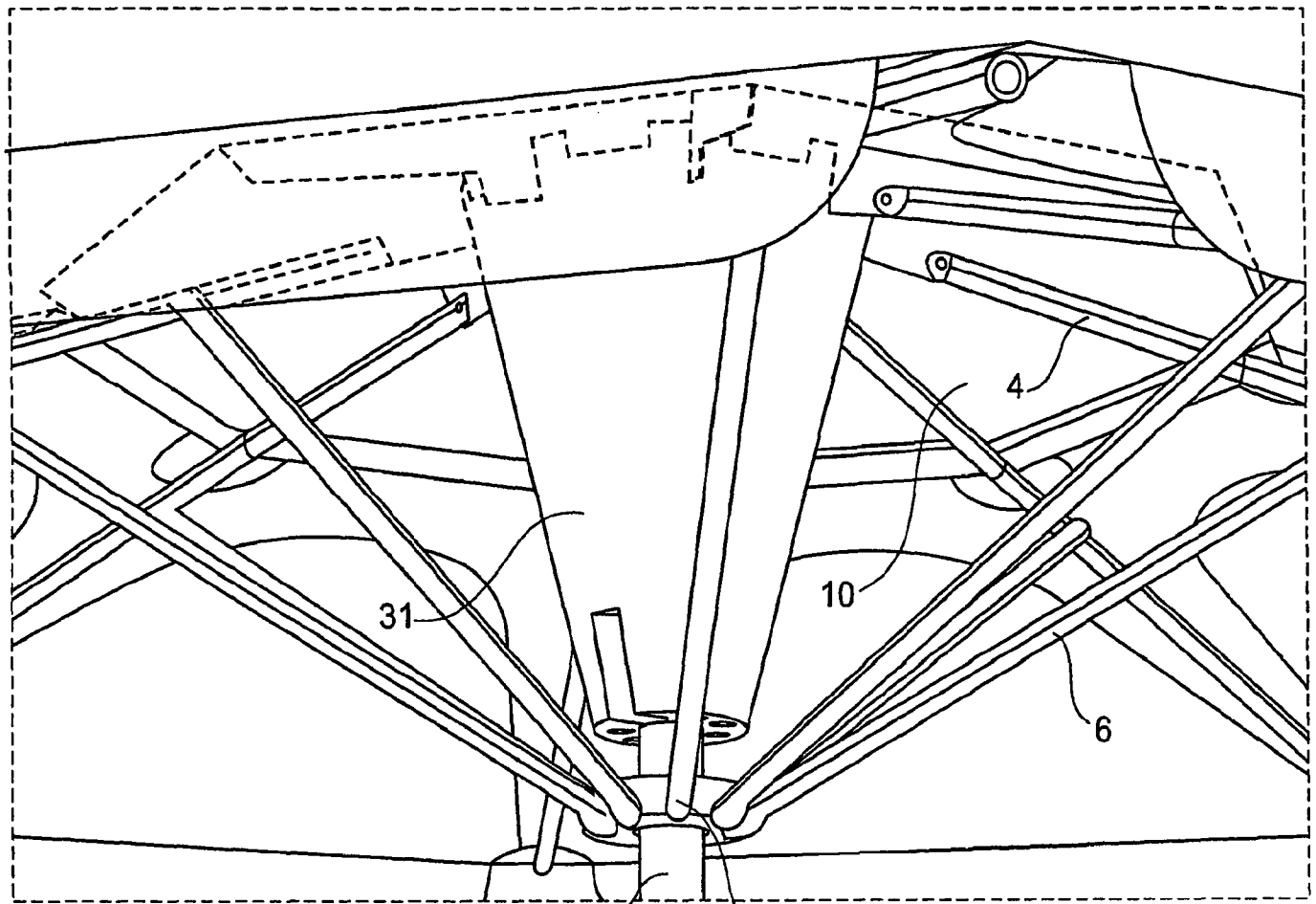
FIG. 11 shows an embodiment of a sunshade/terrace heater with light according to the present invention with a frustoconical grill enclosing a gas lamp.

FIG. 11 illustrates a picture of a sunshade/terrace heater with light and a frusto-conical grill 31 enclosing a lamp (not shown). The grill 31 is disposed under a reflector plate 10. A central column 8 has a longitudinal axis that coincides with the axis of symmetry of the grill. On the central column 8 runs a central slide 7 in which support rods 6 are pivotably hinged. These support rods 6 are connected with further support rods 4.

Figure 12:
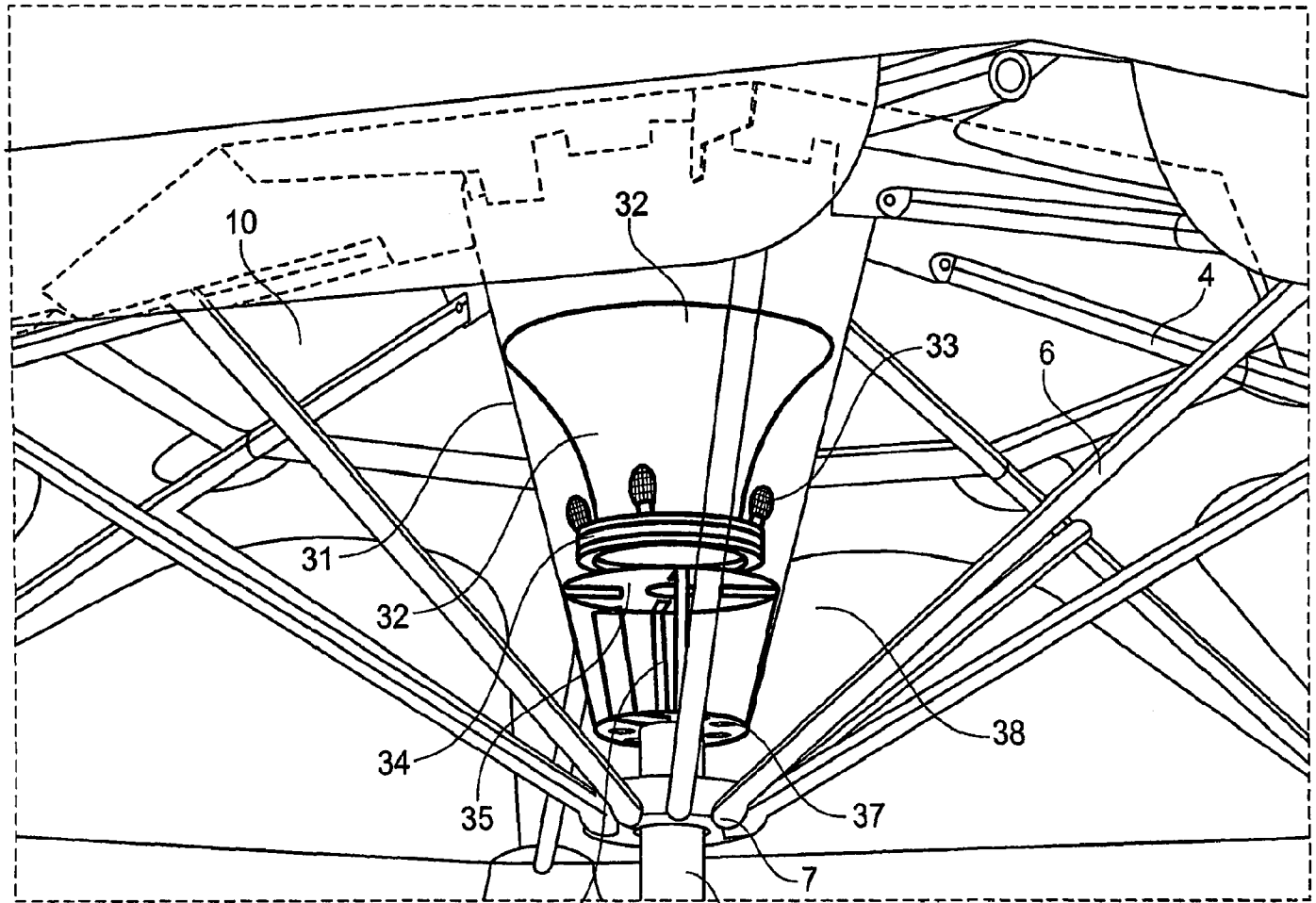
FIG. 12 shows an embodiment of a sunshade/terrace heater with light according to the present invention with a gas lamp designed as a dish enclosed by a grill shaped as a frustum of a cone.

FIG. 12 shows the same sunshade/terrace heater with a gas lamp. The gas lamp 38 consists of a dish 32 surrounded by a grill 31 which is disposed under a reflector 10. A central column 8 has a longitudinal axis that coincides with the axis of symmetry of the grill. On the central column 8 runs a central slide 7 in which support rods 6 are pivotably hinged. These support rods are connected with further support rods 4. The gas lamp 38 is designed as a dish 32 with a vertically extending axis of symmetry and disposed on a burner 34 upon which an array of gas light nozzles 33 are provided. The burner 34 is mounted on a mounting plate 35 with a centrally disposed, circular hole through which a gas line may extend. This mounting plate 35 is supported by legs 36 resting on a transition piece 37 mounted on the central column 8.

Figure 13:
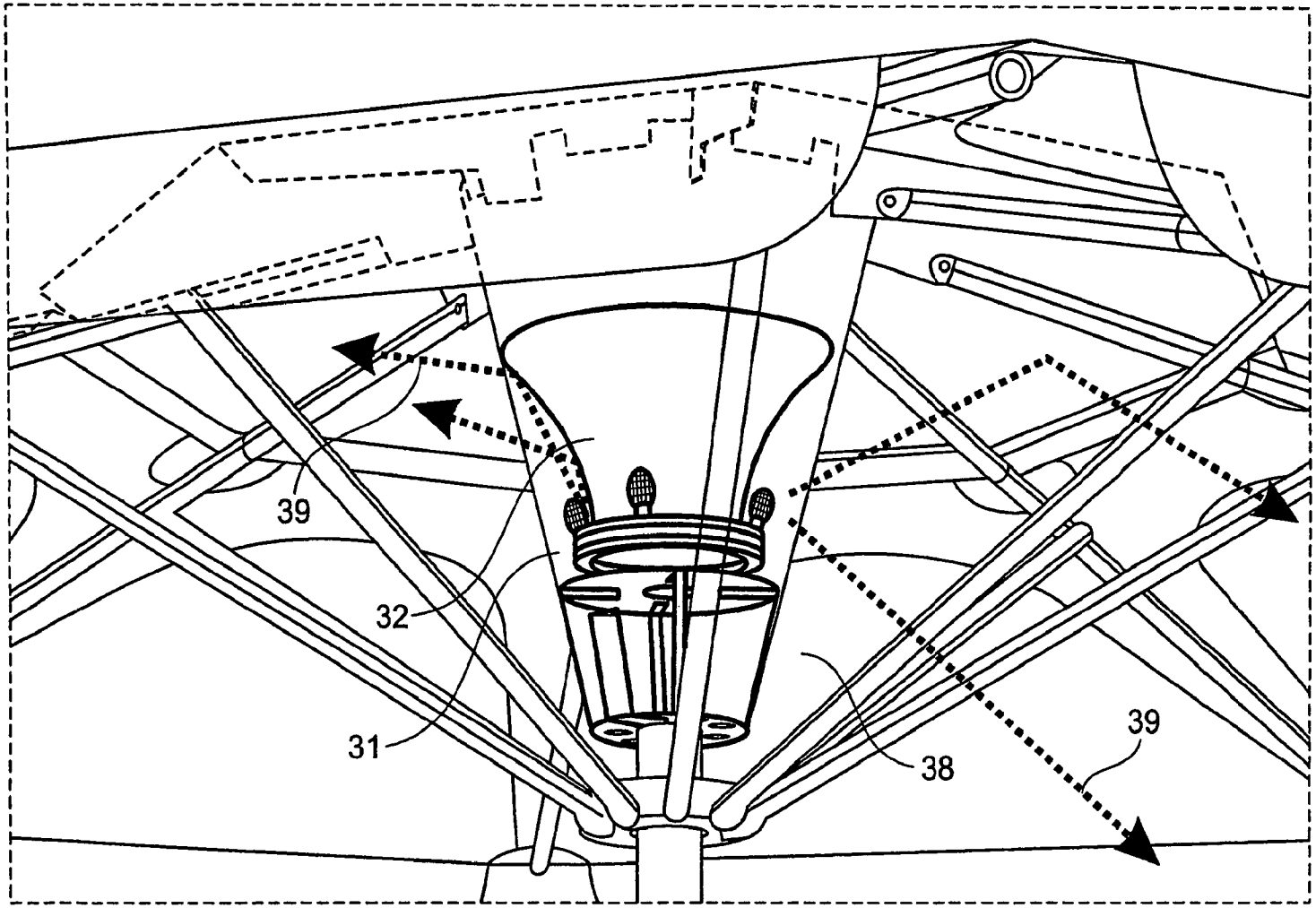
FIG. 13 shows an embodiment of a sunshade/terrace heater with light according to the present invention with a gas lamp emitting light which after reflection via a dish or directly is diffused by a grill.

FIG. 13 shows the same sunshade/terrace heater with light as FIG. 12. The Figure illustrates a gas lamp 38 emitting light 39 which after reflection via a dish 32, or directly, is diffused by a grill 31.

Figure 14:
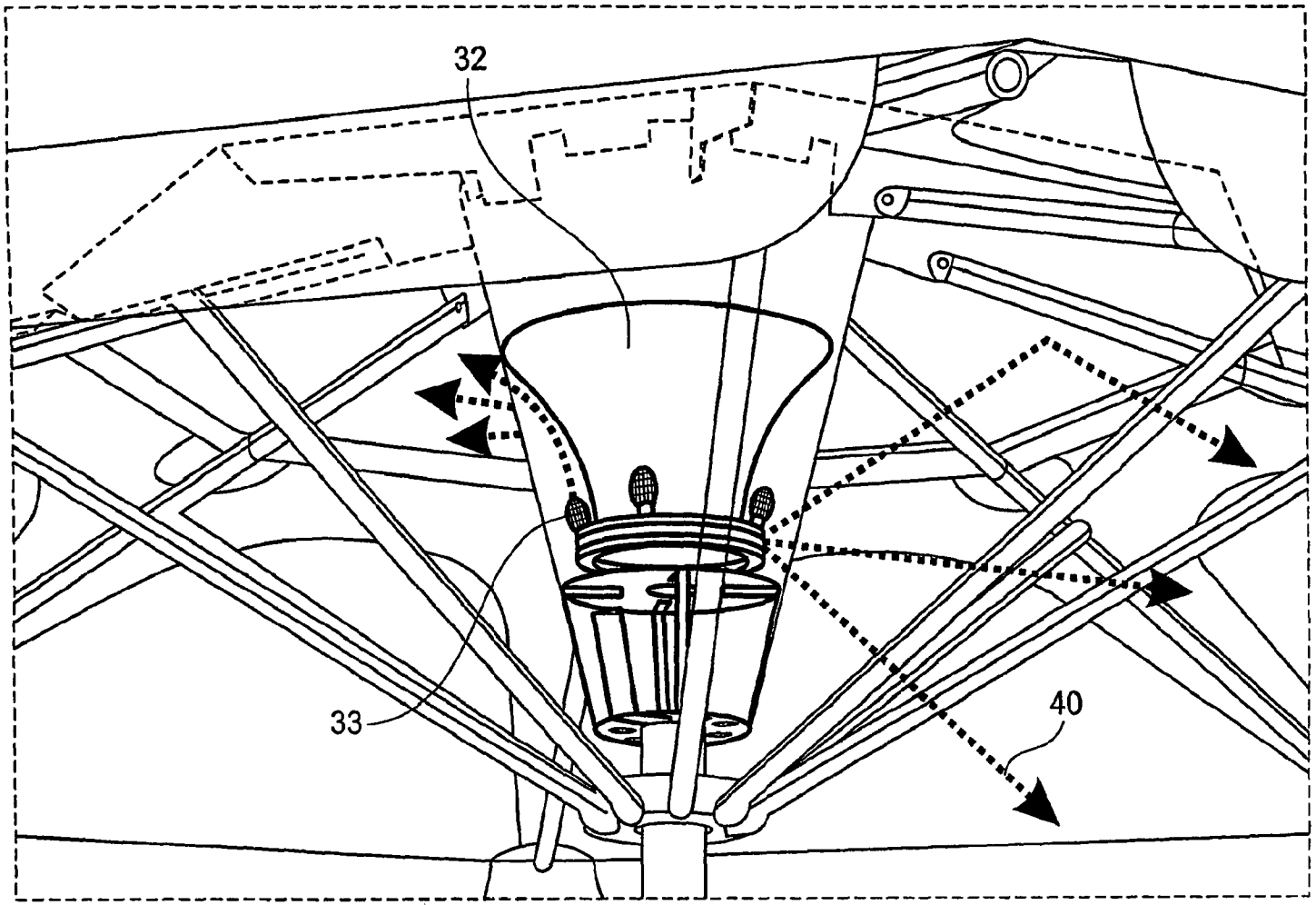
FIG. 14 shows an embodiment of a sunshade/terrace heater with light according to the present invention with a gas lamp emitting heat radiation radiating directly through grill or which is deflected in beforehand by means of a parabola.

FIG. 14 shows the same sunshade/terrace heater with light as FIG. 12. The Figure shows how radiant heat 40 is emitted from a gas light nozzle 33 and deflected by means of a parabola 32, or is radiating directly from a burner 34.

A requirement as to provide reflection of light and heat may be fulfilled by a dish 32 arranged as illustrated on FIGS. 12-14. By using a grill 31 containing collapsible inlets (not shown) or other kinds of access to the enclosed gas light nozzles, it is possible to get access to these gas light nozzles, e.g. in connection with replacement of gas incandescent mantles, or cleaning.

Figure 15:
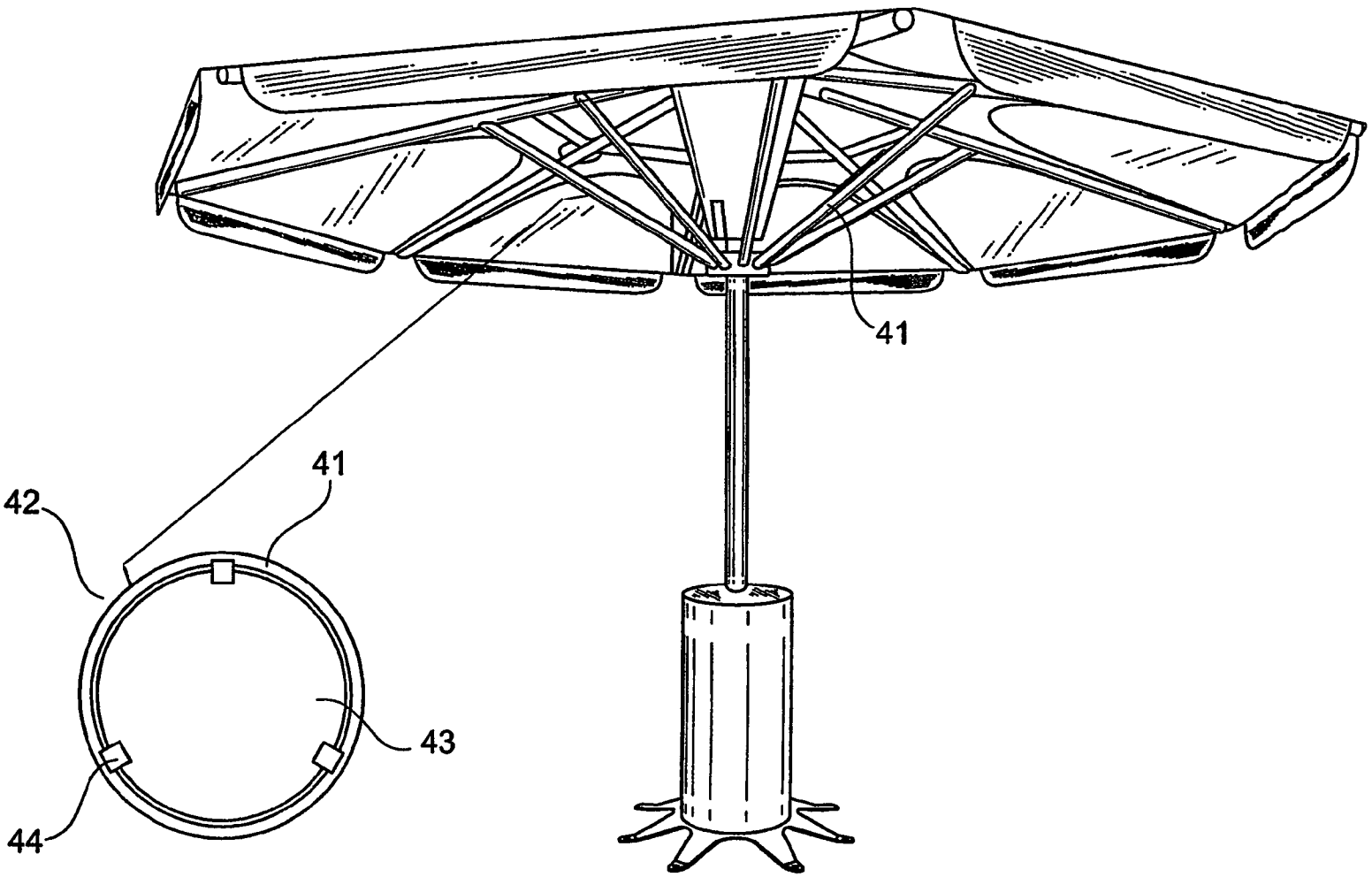
FIG. 15 shows a further embodiment of a sunshade/terrace heater with light according to the invention with a specially designed heat shield.

FIG. 15 illustrates a combined sunshade/terrace heater with light 1 and heat shield 41. The same Figure shows a cross-section of a support rod 4 consisting of a solid wooden core 43 in contact with pins 44 that are connected to a surrounding metal structure 42.

Using a heat shield as illustrated on FIG. 15 protects the used wood against the heat from gas burner as well as light sources. By using a design with minimal contact surface between the outer metal pipe and the inner wooden stick, minimal heat action on the wood is attained.

Figure 16:
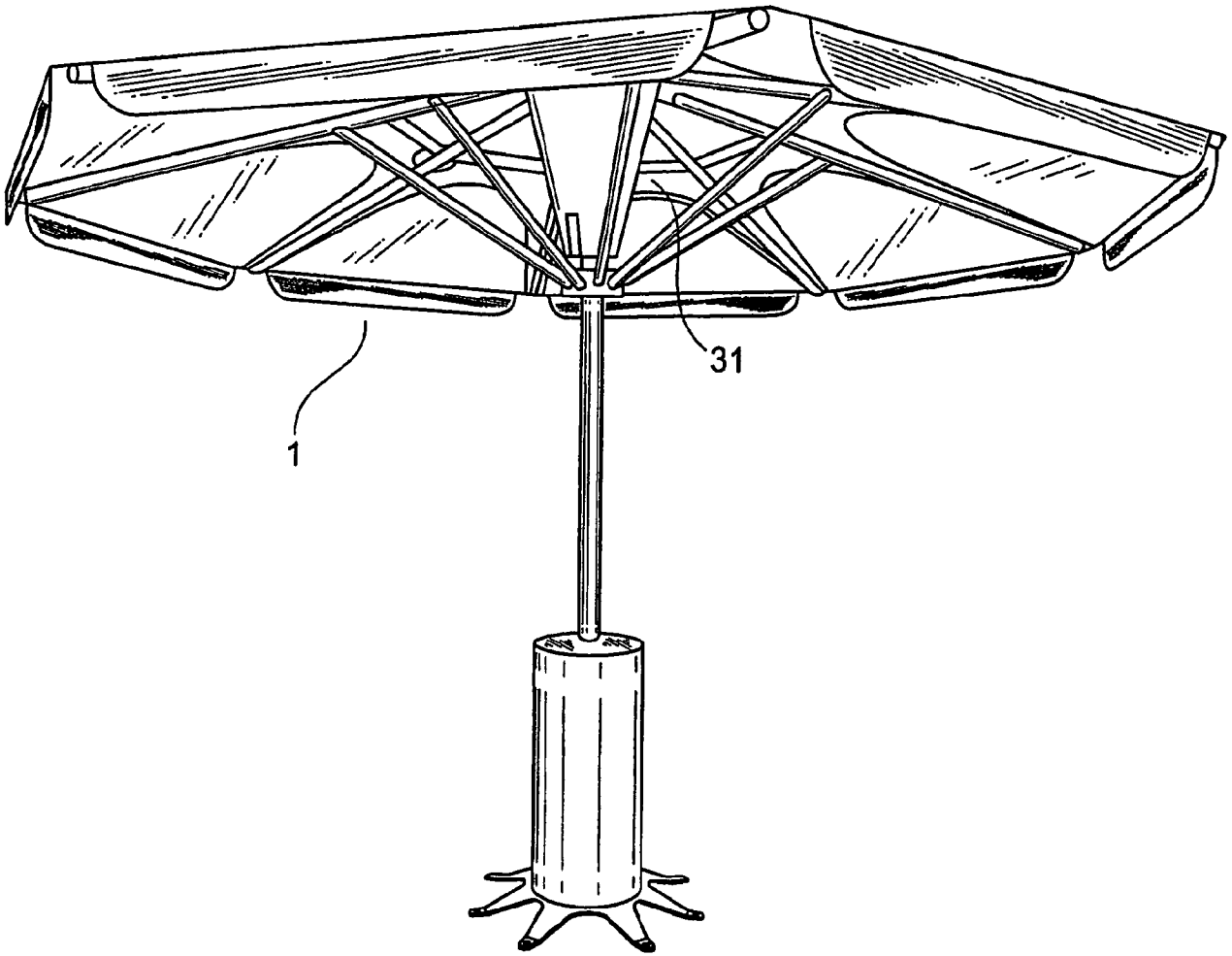
FIG. 16 shows an embodiment of a sunshade/terrace heater with light according to the invention in suspended condition.

FIG. 16 shows a picture of a sunshade/terrace heater with light 1 and a light element (not shown) surrounded by a grill 31.

Figure 17:
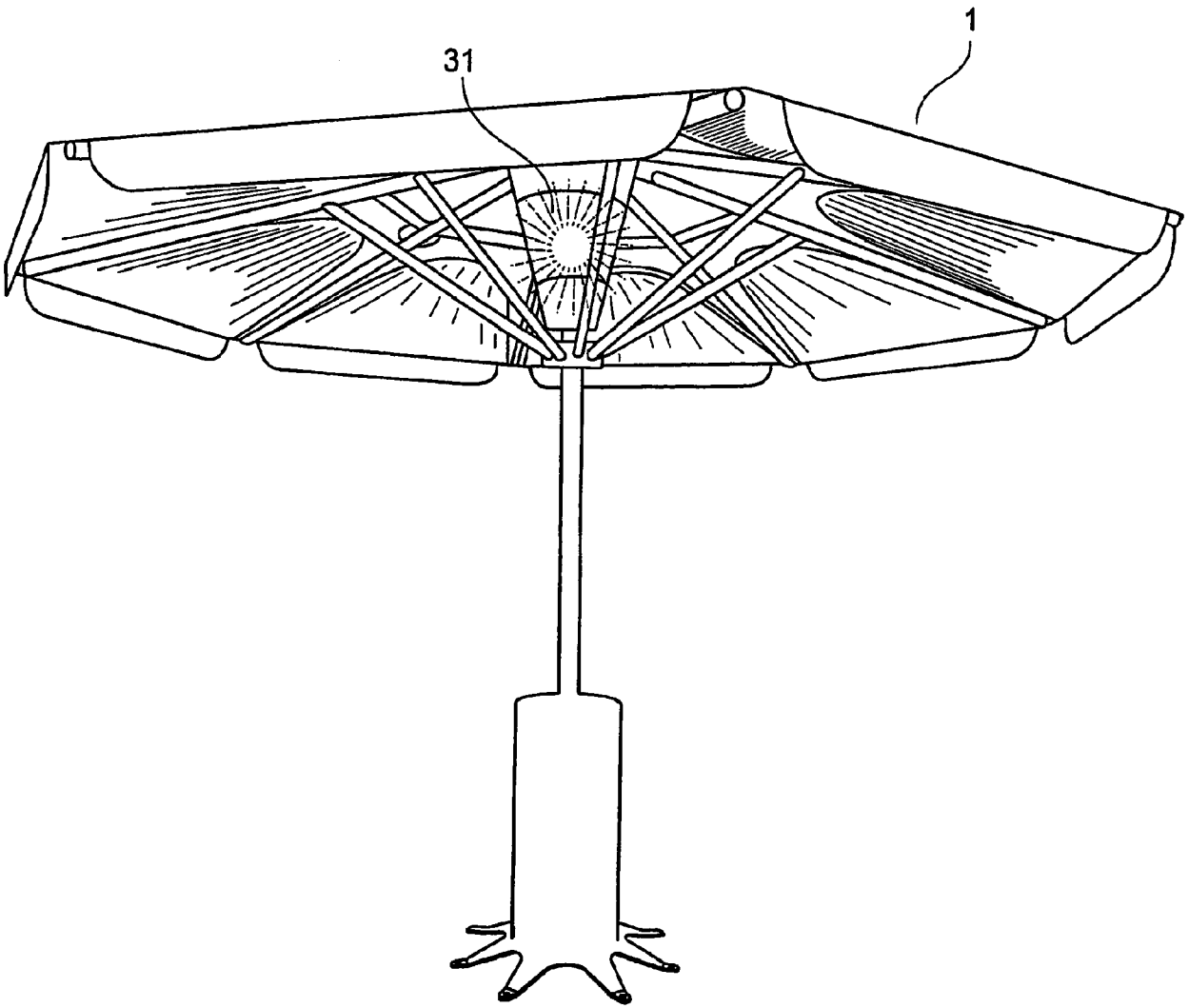
FIG. 17 shows an embodiment of a sunshade/terrace heater with light according to the invention in suspended condition at night.

FIG. 17 illustrates a sunshade/terrace heater with light 1 and a light element surrounded by a grill 31 in the dark.

Figure 18:
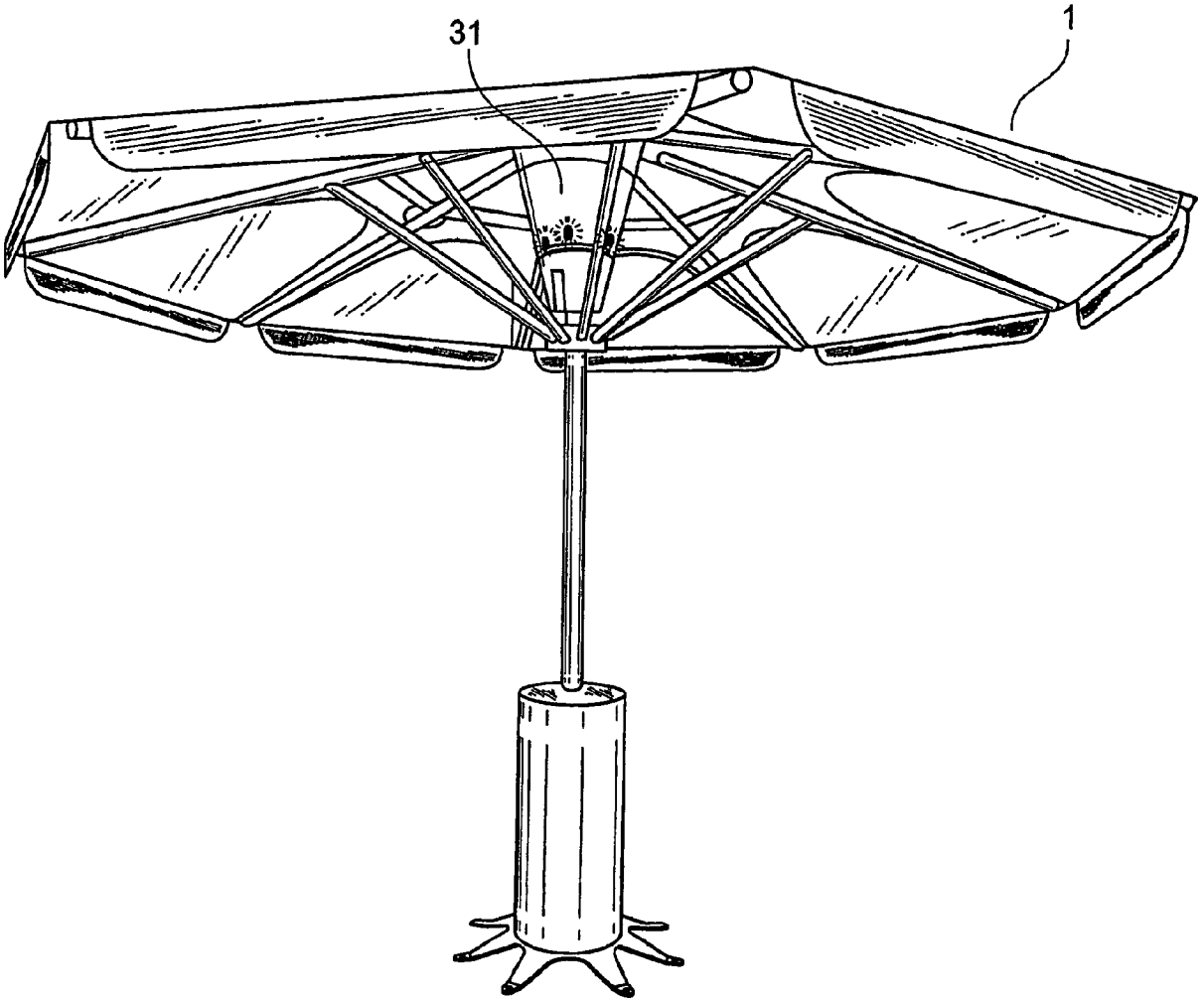
FIG. 18 shows an embodiment of a sunshade/terrace heater with light according to the invention in suspended condition in daylight.

FIG. 18 illustrates a sunshade/terrace heater with light 1 and a light element surrounded by a grill 31 in the daytime.

Figure 19:
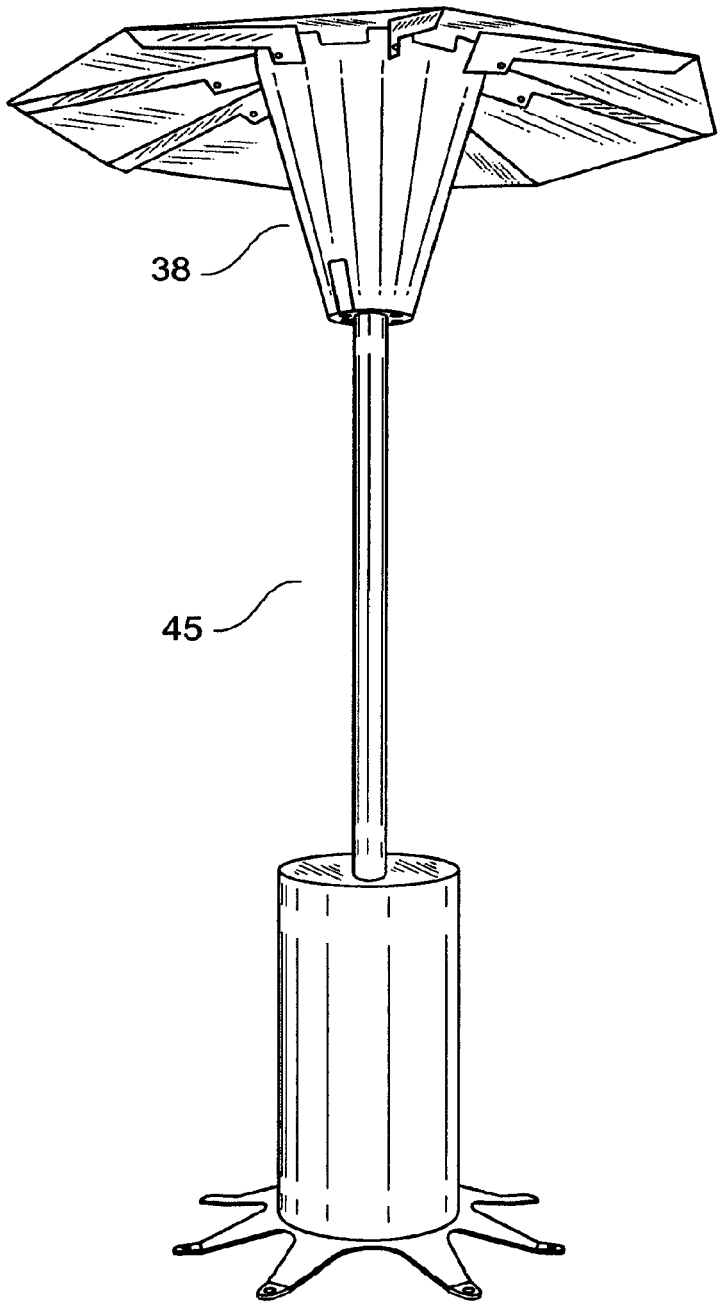
FIG. 19 shows an embodiment of a sunshade/terrace heater with light according to the invention in suspended condition without sunshade.

FIG. 19 shows a terrace heater 45 with a light element 38.

The invention claimed is:

1. A combination of a sunshade and a terrace heater, including a sunshade canopy which is mounted on a canopy support with hinged, pivotable support rods for pivoting between a collapsed state and a suspended state, and with at least one heater element with lattice cage and disposed hereinabove a reflector plate arranged at a top of a central column, wherein the canopy is an annular body with a central aperture, wherein the reflector plate has a circumference largely corresponding to the central aperture, wherein the reflector plate extends out from the lattice cage with a distance at least corresponding to a height of the lattice cage, wherein the support rods are hinged at the inner side of the reflector plate at a position close to the lattice cage so that the annular body of the canopy in the collapsed state is disposed under the lattice cage wherein each support rod is provided with a heat shield at least on a side facing the lattice cage.

2. Combination according to claim 1, further comprises at least one light element.

3. Combination according to claim 2, wherein the at least one light element is powered with energy from the same source of energy as the at least one heater element.

4. Combination according to claim 2, wherein the at least one heater element is a gas burner.

5. Combination according to claim 2, wherein the at least one heater element is an electric heater.

6. Combination according to claim 1, wherein the at least one heater element is a gas burner.

7. Combination according to claim 1, wherein the at least one heater element is an electric heater.

8. Combination according to claim 1, wherein the lattice cage at positions opposite the support rods have areas without lattice openings closed for screening off radiant heat against the support rods in collapsed state.

9. Combination according to claim 1, wherein the heat shield is formed of a part of the support rod itself, as it is made with a slit so that transfer of heat to the outwards facing side of the support rod is prevented.

10. Combination according to claim 1, wherein the heat shield is formed of a bent sheet mounted on and spaced apart from the support rod.

11. Combination according to claim 1, wherein the sunshade canopy and the canopy support are detachably mounted on the central column.

12. Combination according to claim 1, wherein at a lower end of the central column includes a cage with a gas cylinder and that it contains a gas line for feeding the gas burner.

13. Combination according to claim 1, wherein at a lower end of the central column, mounting means are provided for fastening to a base.

14. Combination according to claim 1, wherein the sunshade canopy is made of a non-combustible material.

15. Combination according to claim 14, wherein the material is selected from the group consisting of carbon, Kevlar, and combinations thereof.

16. Combination according to claim 1, wherein the reflector plate has a shape for providing rigidity in the structure.

17. Combination according to claim 16, wherein the shape of the reflector plate is selected from the group consisting of polygonal, pyramidal, circular, frusto-conical, and combinations thereof.

* * * * *